US011619197B2

(12) United States Patent
Lechner et al.

(10) Patent No.: US 11,619,197 B2
(45) Date of Patent: Apr. 4, 2023

(54) MOTORIZED WORKING APPARATUS AND AIR FILTER

(71) Applicant: Andreas Stihl AG & Co. KG, Waiblingen (DE)

(72) Inventors: Sebastian Lechner, Waiblingen (DE); Alexander Maier, Wildberg (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 17/029,439

(22) Filed: Sep. 23, 2020

(65) Prior Publication Data

US 2021/0088011 A1 Mar. 25, 2021

(30) Foreign Application Priority Data

Sep. 24, 2019 (EP) ..... 19199115

(51) Int. Cl.
*F02M 35/024* (2006.01)

(52) U.S. Cl.
CPC *F02M 35/02425* (2013.01); *F02M 35/02433* (2013.01)

(58) Field of Classification Search
CPC ..... F02M 35/02425; F02M 35/02433; F02M 35/1017; F02M 35/10; F02M 35/10032;
(Continued)

(56) References Cited

U.S. PATENT DOCUMENTS 3,346,955 A * 10/1967 Beneke ..... A01G 3/053 30/296.1
4,693,735 A * 9/1987 Wehle ..... B27B 17/00 30/381

(Continued)

FOREIGN PATENT DOCUMENTS

CN 203019328 U 6/2013
DE 10 2005 031 501 A1 1/2007

(Continued)

*Primary Examiner* — Robert A Hopkins
*Assistant Examiner* — Qianping He
(74) *Attorney, Agent, or Firm* — Crowell & Moring LLP

(57) ABSTRACT

A motorized working apparatus includes a housing having an air inlet, an air guide leading from the air inlet into the housing, and an air filter which is curved hood-shaped outwardly and covers the air inlet of the housing. The air filter includes a filter frame body with a filter-fabric-free air outlet face facing the air inlet of the housing and with a window frame structure protruding over the filter-fabric-free air outlet face and having at least one window region. A filter fabric occupies the at least one window region, and a fixation releasably fixes the filter frame body to the housing. The window frame structure has frame webs which delimit the at least one window region and which protrude relative to the filter fabric towards an air supply side in the at least one window region and include web side edges which run sloping at an obtuse angle relative to adjacent window planes, and/or the fixation includes a pre-fixing clamping holding arrangement and a final fixing holding arrangement which are independent of each other, and/or the window frame structure of the air filter protrudes over the filter-fabric-free air outlet face in the shape of a roof with a triangular cross-sectional form.

21 Claims, 4 Drawing Sheets

(58) Field of Classification Search
CPC ..... F02M 35/10242; F02M 35/10288; F02M 35/024; F02M 356/0203; B25F 5/008; B25F 5/02; B01D 46/0005; B01D 46/24; B01D 46/0004; B01D 2297/60; B24B 23/028; F01P 11/12; B02M 35/1019; Y10S 55/30; Y10S 55/28
USPC ..... 123/41.63; 55/385.3, 495
See application file for complete search history.

(56) References Cited

U.S. PATENT DOCUMENTS

| | | | | |
|---|---|---|---|---|
| 5,363,815 | A * | 11/1994 | Pretzsch | F01P 5/06 123/198 E |
| 8,398,465 | B2 | 3/2013 | Hoeschele et al. | |
| 9,597,624 | B2 | 3/2017 | Hiller | |
| 2003/0172899 | A1 | 9/2003 | Geyer et al. | |
| 2007/0220848 | A1* | 9/2007 | Diepolder | F02M 35/024 55/385.3 |
| 2007/0266966 | A1* | 11/2007 | Ohsawa | F01P 11/12 123/41.63 |
| 2008/0196687 | A1* | 8/2008 | Kohler | F02M 35/0203 123/198 E |
| 2012/0124842 | A1 | 5/2012 | Yuasa | |
| 2016/0052372 | A1* | 2/2016 | Ferreira | B60H 3/0616 55/483 |
| 2018/0326337 | A1 | 11/2018 | Esenwein et al. | |

FOREIGN PATENT DOCUMENTS

| | | | |
|---|---|---|---|
| DE | 10 2012 012 606 | A1 | 1/2014 |
| DE | 10 2014 106 693 | A1 | 11/2015 |
| EP | 2 240 302 | B1 | 1/2013 |
| EP | 3 109 006 | A1 | 12/2016 |
| JP | 6252778 | B2 | 12/2017 |
| WO | WO 2017/102125 | A1 | 6/2017 |

* cited by examiner

MOTORIZED WORKING APPARATUS AND AIR FILTER

CROSS REFERENCE TO RELATED APPLICATION

This application claims priority under 35 U.S.C. § 119 from European Patent Application No. 19199115.7, filed Sep. 24, 2019, the entire disclosure of which is herein expressly incorporated by reference.

BACKGROUND AND SUMMARY OF THE INVENTION

The invention relates to a motorized working apparatus having a housing with an air inlet, an air guide leading from the air inlet into the housing, and an air filter which is curved hood-like towards the outside and covers the air inlet of the housing, and which comprises a filter frame body with a filter-fabric-free air outlet face facing the air inlet of the housing and with a window frame structure protruding over the filter-fabric-free air outlet face and having at least one window region, a filter fabric occupying the at least one window region, and a fixation for releasable fixing of the filter frame body to the housing, and an air filter for this.

Such working apparatuses are used for example as manually guided, motorized gardening or forestry working apparatuses such as hedge cutters, hedge shears, strimmers, pruners, leaf-blowers, sweepers, power saws, lawnmowers and scarifiers, wherein an internal combustion engine or a battery-powered electric motor serves as a motorized drive. The air guide serves e.g. to supply combustion air to the internal combustion engine or to supply cooling air to an electric motor or internal combustion engine. The air filter prevents an undesirable penetration of dirt particles and similar into the apparatus housing via the air inlet with the air supplied, which is typically drawn in by means of a fan.

Laid-open publication DE 10 2005 031 501 A1 discloses a motorized working apparatus of the type cited initially, e.g. in the form of a power saw, with an internal combustion engine which draws in combustion air from the environment via the air inlet on the apparatus housing. The air filter is arranged in front of the air inlet into the housing, and is held releasably on the apparatus housing by means of snap hooks. In the air filter used there, the window frame structure forms a cuboid multisurface structure with accordingly five air inlet faces adjoining each other at an angle along associated frame side edges, comprising a front inlet face opposite the air outlet face and four short-side inlet faces each adjacent to the front inlet face and the air outlet face.

As an alternative to the type of motorized working apparatuses considered here, in which the air filter is curved hood-like towards the outside and covers the air inlet of the apparatus housing, in another type of motorized working apparatus it is provided that the air filter covers the air inlet of the apparatus housing with conformity, i.e. the window frame structure with the one or several window regions occupied by filter fabric has a shape similar to that of the air inlet of the apparatus housing, for example with a flat or curved surface. Working apparatuses of this type and associated air filters are disclosed for example in utility model publication CN 203019328 U, patent publication JP 6252778 B2, and laid-open publications EP 3 109 006 A1, DE 10 2012 012 606 A1 and DE 10 2014 106 693 A1.

Laid-open publication WO 2017/102125 A1 discloses a hand tool machine with a filter carrier consisting of two half-shells that are hinged together, can be laid around the hand tool machine and then releasably connected together at their free ends, e.g. by means of hook-and-loop tape closures, so as to cover air inlets arranged on opposite sides of the machine housing.

Patent publication EP 2 240 302 B2 discloses an electric hand tool apparatus, in particular in the form of an angle grinder, in which air inlets arranged on opposite housing sides are covered by a semicylindrical air filter which may be pushed onto the apparatus housing with a degree of elastic deformation, and engaged or clipped into an undercut position on the apparatus housing.

It is an object of the invention to provide a motorized working apparatus of the type cited initially, and an air filter which can be used in particular for such a working apparatus, with characteristics with respect to production and/or installation complexity and/or filter functionality and/or cleaning suitability which are improved in comparison with the prior art outlined above.

The invention achieves this and other objects by providing a motorized working apparatus comprising a housing with an air inlet, an air guide leading from the air inlet into the housing, and an air filter which is curved hood-shaped outwardly and covers the air inlet of the housing, and which comprises a filter frame body with a filter-fabric-free air outlet face facing the air inlet of the housing and with a window frame structure protruding over the filter-fabric-free air outlet face and having at least one window region, a filter fabric occupying the at least one window region, and a fixation for releasable fixing of the filter frame body to the housing, wherein the air filter further comprises one or more specific features.

The invention achieves said and other objects also by providing an air filter having the before mentioned characteristics. Advantageous refinements of the invention are given in the subclaims, the wording of which is hereby made a constituent part of the description by reference.

According to one aspect of the invention, the window frame structure of the air filter has frame webs which delimit the window region or regions, protrude relative to the filter fabric towards an air supply side in the window region or regions, and comprise web side edges which run sloping at an obtuse angle relative to adjacent window planes. This design of frame webs offers significant advantages with respect to simple cleaning of the air filter and/or with respect to a favorable air flow behavior of air conducted through the air filter, in particular in the region of the frame webs. In particular, this specific design of the frame webs facilitates the removal of dirt from the outside of the air filter, in particular in the window region or regions, since the frame webs protrude relative to the filter fabric with sloping edges running at an obtuse angle, which facilitates the stripping of dirt that has settled on the filter fabric. In particular, the sloping edge profile facilitates the scraping of dirt from the transitions between the filter fabric and the frame webs.

According to a further aspect of the invention, the fixation of the air filter comprises a pre-fixing clamping holding arrangement and a final fixing holding arrangement which are independent of each other. This configuration of the fixation has the advantage that the air filter with its filter frame body may be pre-fixed to the apparatus housing by the pre-fixing clamping holding arrangement, and then definitively fixed to the apparatus housing in releasable fashion by the final fixing holding arrangement. Because of the pre-fixing to the apparatus housing, the air filter need no longer be handled or held by the user during final fixing to the apparatus housing. This facilitates the final fixing of the air filter to the apparatus housing.

According to a further aspect of the invention, the window frame structure of the air filter protrudes over the filter-fabric-free air outlet face in the shape of a roof with a triangular cross-sectional form. For corresponding applications, this configuration of the window frame structure has both stylistic advantages and advantages with respect to optimal air supply to the air inlet of the apparatus housing. Furthermore, this configuration of the window frame structure may hinder the deposit of dirt particles and similar on the filter fabric, since dirt particles carried by the aspirated air can slip more easily off the roof shape of the window frame structure than e.g. off a filter-fabric surface parallel to the air inlet of the housing and therefore perpendicular to the main flow direction of the aspirated air.

In a refinement of the invention, the window frame structure of the air filter forms a multisurface structure with at least four air inlet faces adjoining each other at an angle along associated frame side edges. This constitutes an advantageous embodiment of the window frame structure. In alternative designs, the window frame structure forms only a one-piece surface occupied by filter fabric, or a multisurface structure with only two or three air inlet faces adjoining each other along associated frame side edges.

In one embodiment of the invention, the at least four air inlet faces comprise a quadrangular front inlet face adjoining the air outlet face at an acute angle, a quadrangular bottom inlet face adjoining the front inlet face and adjoining the air outlet face at an acute angle, and two triangular transverse inlet faces each adjoining the air outlet face, the front inlet face and the bottom inlet face. This constitutes a further advantageous implementation of the window frame structure of the air filter. In alternative embodiments, the front inlet face has more than four corner regions and/or has transverse inlet faces with more than three corner regions.

In a refinement of the invention, the filter frame body of the air filter is an injection moulding of a plastic material, and the filter fabric is a metallic filter fabric which is over-moulded on the edges by the plastic material of the filter frame body. This constitutes an implementation which is advantageous in particular with respect to production complexity and adequate stability of the filter frame body or high strength of the connection of the filter fabric to the filter frame body. Alternatively, the filter frame body is produced by another conventional production process, optionally also made of a metallic material, and/or the filter fabric consists of a plastic material.

In a refinement of the invention, the final fixing holding arrangement of the air filter is a screw connection with a fixing screw and a screw sleeve which is formed on the filter frame body, and on the sleeve outer periphery of which the pre-fixing clamping holding arrangement is formed, and/or in which the fixing screw is captively received. This screw connection allows the air filter to be releasably attached to the apparatus housing easily and reliably and with sufficient strength. Advantageously, the screw sleeve fulfils a double function: firstly to receive the fixing screw and secondly to provide the pre-fixing clamping holding arrangement. The captive receiving of the fixing screw by the screw sleeve has the advantage that the fixing screw is already at the required position when the air filter is prepared by the user for pre-fixing to the apparatus housing. In alternative embodiments, there is no captive receiving of the fixing screw, and/or the final fixing holding arrangement is not a screw connection but another conventional releasable connection, e.g. a releasable snap connection.

In a refinement of the invention, the working apparatus contains a working tool outside the apparatus housing and a connecting shaft between the working tool and the apparatus housing, wherein the air inlet is situated on a half of the housing facing the working tool. For corresponding applications, this constitutes a favorable positioning of the air inlet and hence also of the air filter covering this. Alternatively, the air inlet with the covering air filter may be situated at another location on the apparatus housing, e.g. on a half of the apparatus housing facing away from the working tool. In further alternative embodiments, the working tool is situated inside the apparatus housing or on the apparatus housing, and/or the working tool is situated outside the apparatus housing without a connecting shaft running in between.

In a refinement of the invention, the working apparatus is configured for operation in at least one predefined usage position, and the air inlet covered by the air filter is situated in a region of the housing pointing downward in this usage position. This has the advantage that dirt captured by the air filter can more easily detach from the filter fabric automatically because the dirt can fall down under the effect of gravity. In corresponding designs, the working apparatus may have several predefined usage positions, e.g. a horizontal and a vertical usage position, wherein in this case, according to this refinement of the invention, the air inlet covered by the air filter is situated in a downward-pointing region of the apparatus housing in at least one of these predefined usage positions. In alternative embodiments, the air inlet and covering air filter are not situated in a downward-pointing region of the housing in any predefined usage position of the apparatus, but e.g. are situated in a lateral or upward-pointing region of the apparatus housing.

In a refinement of the invention, the working apparatus comprises in the housing an apparatus component to be cooled, a cooling air fan and a cooling air guide which leads from the air inlet of the housing, via the apparatus component to be cooled and the cooling air fan, to an air outlet of the apparatus housing, wherein the air outlet is situated in a side region of the apparatus housing between a housing front side and a housing rear side, e.g. on an underside, a top side or a side face of the apparatus housing. For corresponding applications, this constitutes an advantageous implementation of the guidance of cooling air for the apparatus component to be cooled in the apparatus housing, e.g. for a drive motor accommodated there. In alternative embodiments, the cooling air guide is configured differently, and/or an internal combustion engine is provided in the apparatus housing to which combustion air is supplied via the air inlet, for which then a corresponding combustion air guide is provided.

In an embodiment of the invention, the working apparatus comprises a housing seal which seals the housing at least on a suction side of the cooling air fan against supply air and/or dirt ingress as far as the air inlet. This promotes a targeted aspiration of largely dirt-free cooling air, as far as possible exclusively via the air inlet provided for this and covered by the air filter. The housing seal may e.g. comprise a rubber seal and/or a labyrinth seal which is formed by corresponding rib-like housing wall portions. In alternative embodiments, the housing seal is completely air-tight, or not completely air-tight but sufficiently air-tight that the quantity of air and/or dirt ingress lies below a predefinable threshold value, and in this way does not perceptibly disrupt the cooling function of the filtered air drawn in via the air inlet.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
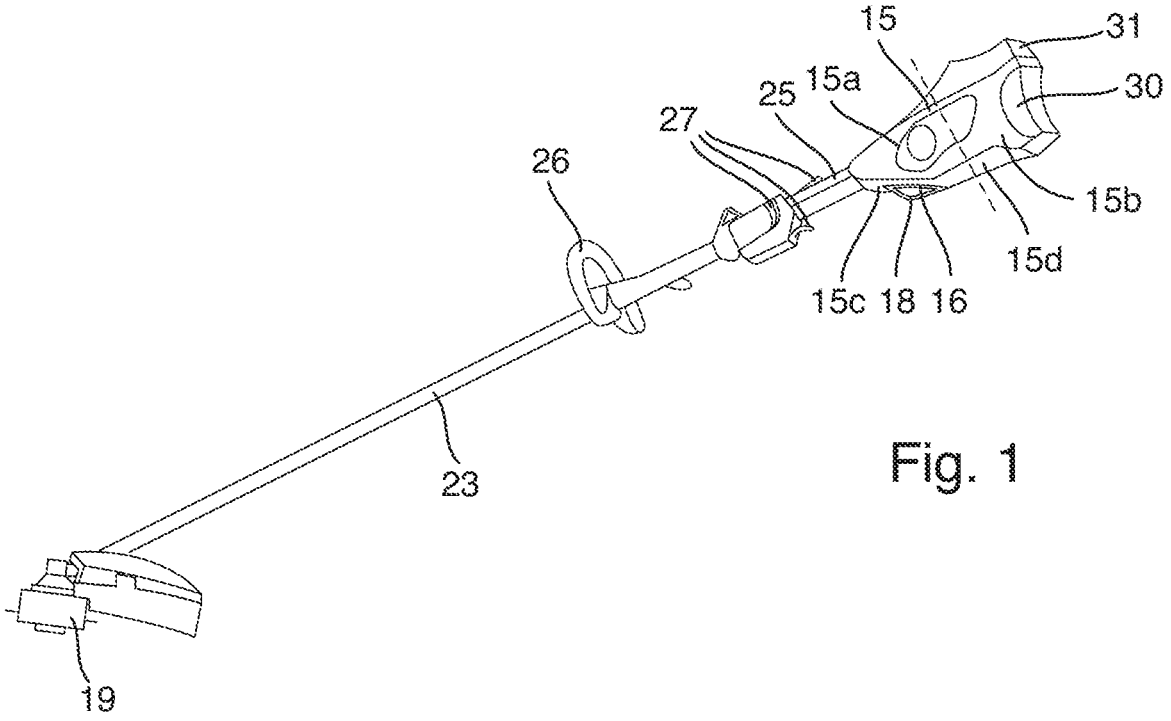
FIG. 1 a perspective side view of a motorized working apparatus.
Figure 2:
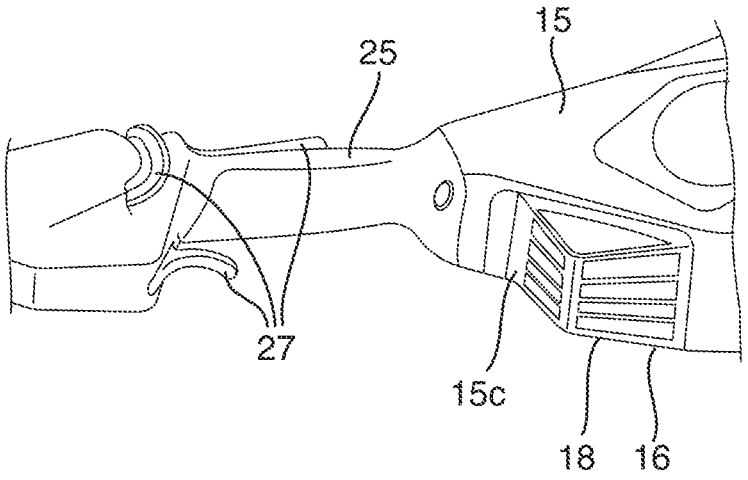
FIG. 2 a perspective, detail side view of the working apparatus in a region with air filter.

The motorized working apparatus shown in FIGS. 1 to 4 contains a housing 15 having an air inlet 16, an air guide 17 which leads from the air inlet 16 into the housing 15, and an air filter 18 which covers the air inlet 16 of the housing 15 and is curved hood-shaped towards the outside. The working apparatus may in particular be a manually guided gardening or forestry working apparatus of one of the types cited above.

In corresponding embodiments, as in the example shown, the working apparatus contains a working tool 19 outside the housing 15, and a connecting shaft 23 between the working tool 19 and the housing 15, wherein the air inlet 16 is situated on a half 15*a* of the housing 15 facing the working tool 19. In the example shown, a half 15*b* of the housing 15 facing away from the working tool 19 forms a rear end of the housing 15 and of the working apparatus as a whole. As an alternative to such a design as a so-called shaft apparatus, the working apparatus may also be of the shaftless apparatus type, e.g. a power drill or angle grinder or similar.

In corresponding embodiments, as in the example shown, the working apparatus is configured for operation in at least one predefined usage position, and the air inlet 16 covered by the air filter 18 is situated in a region 15*c* of the housing 15 pointing downward in this usage position, as shown in FIG. 1 for the working apparatus in FIGS. 1 to 4. In the usage position shown in FIG. 1, the working apparatus may for example be used in a design as a lawn trimmer, wherein the working tool 19 is configured in a manner known in itself and not therefore described here in detail.

In the example shown, the user may hold the working apparatus at a rear handle 25 and at a front handle 26, and control it via a control element assembly 27 situated e.g. on or close to the rear handle 25. Optionally, depending on design, the working apparatus may have one or more further usage positions in which the air inlet 16 is also situated in a downward-pointing region of the housing 15, or alternatively in a region of the housing 15 not pointing downward. The downward-pointing orientation of the air inlet 16 and hence also of the air filter 18 covering this, in the respective usage position has e.g. the advantage that aspirated dirt which has settled on the outside of the air filter 18 can detach from the air filter 18 again automatically under gravity and fall down, or can easily be scraped off the air filter 18 by the user. In the example shown, the handle comprises two handle half-shells, of which the handle half-shell on the visible side has been removed in FIG. 4.

In corresponding embodiments, as in the example shown, the working apparatus comprises in the housing 15 an apparatus component 20 to be cooled and a cooling air fan 21, wherein the air guide 17 forms a cooling air guide which leads from the air inlet 16 of the housing 15, via the apparatus component 20 to be cooled and the cooling air fan 21, to an air outlet 24 of the housing 15 which is situated in a region 15*d* of the housing 15 between a housing front side 15*e* and a housing rear side 15*f*. The course of the air guide 17, functioning in this case as a cooling air guide, is indicated schematically in FIG. 4 by dotted lines, wherein for greater clarity of the air guide 17, a housing side wall on the visible side and a fan housing have been removed, i.e. are not shown. The region 15*d* of the air outlet 24 may, as shown, be situated on an underside of the housing 15, alternatively on the top side or a side region of the housing 15.

Figure 3:
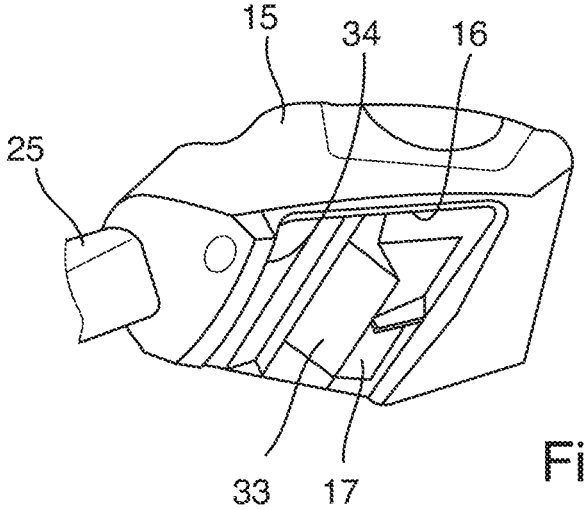
FIG. 3 a perspective, detail side view of the working apparatus in the region of an air inlet without the covering air filter.

The apparatus component 20 to be cooled may for example be a drive motor to be cooled for the working tool 19. In this case, a drive shaft runs in the known fashion through the connecting shaft 23 from the drive motor into the housing 15, then functioning as a motor housing, to the working tool 19 on the front. Depending on requirements, one or more further tool components to be cooled, e.g. an electric control unit, may be situated in the air guide 17 either directly or via an associated cooling body structure 33 as shown in FIG. 3.

In corresponding embodiments, as in the example shown, the working apparatus is a battery-powered apparatus for which then the housing 15 contains a battery receiving frame 29 for insertion of an accumulator unit or battery pack.

In corresponding embodiments, as in the example shown, the working apparatus comprises a housing seal 28 which seals the housing 15 largely air-tightly on at least a suction side of the cooling fan 21 except for the air inlet 16. In the exemplary embodiment shown, the suction side of the cooling air fan 21 is formed by the part of the housing 15 situated on the left of the cooling air fan 21 in FIG. 4, while the pressure side is on the right of the cooling air fan 21 in FIG. 4. In the example shown, the apparatus component 20 or drive motor to be cooled is on the suction side, while the battery-receiving space 29 is on the pressure side. The housing seal 28 is implemented in a fashion known in itself and not therefore explained in detail here, e.g. via corresponding labyrinth seals and/or rubber sealing profiles along constituent parts of the housing 15 adjoining each other along separating edges, such as a housing shell body 30 and a housing cover 31, and along a separating edge between the housing 15 and the air filter 18.

Figure 4:
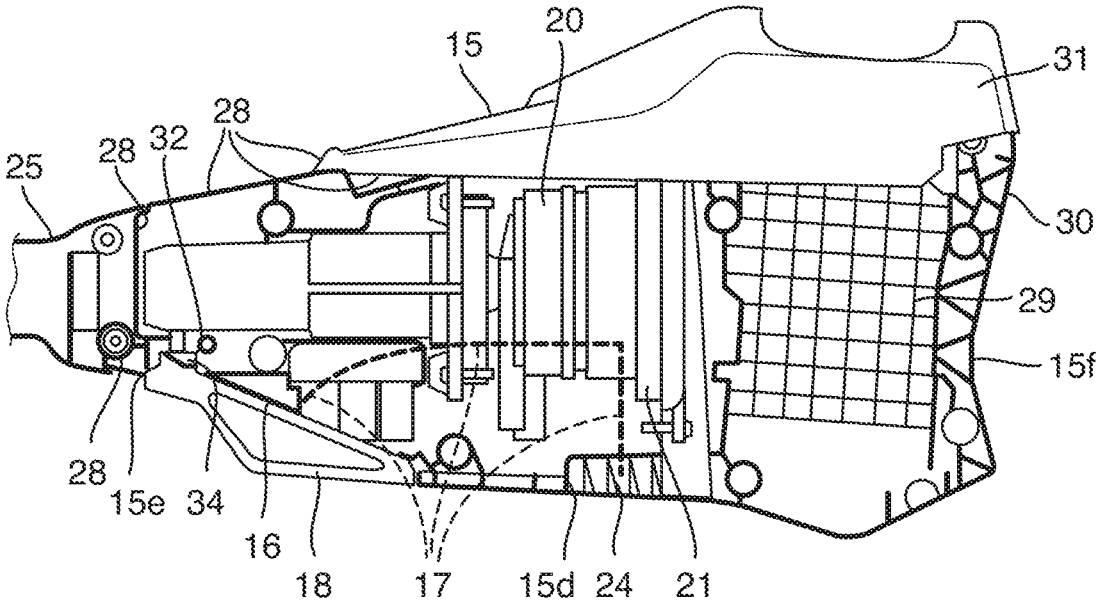
FIG. 4 a side view of a housing part of the working apparatus with the housing side wall and operating handle half-shell removed.
Figure 5:
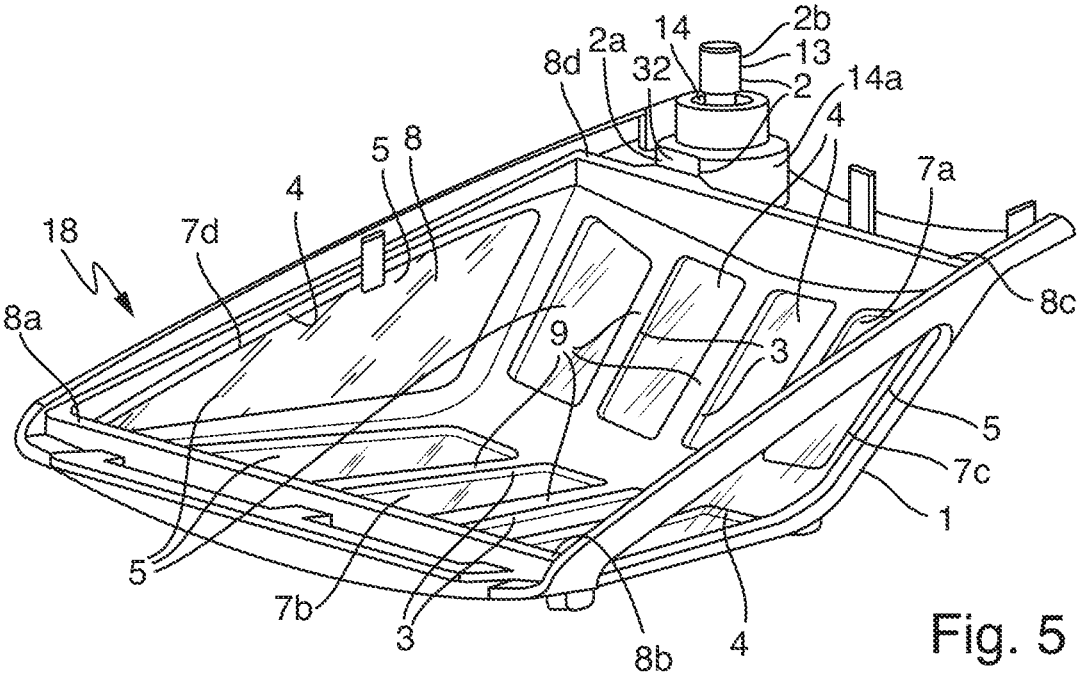
FIG. 5 a perspective, top view of an inside of an air filter which can be used for the working tool.
Figure 6:
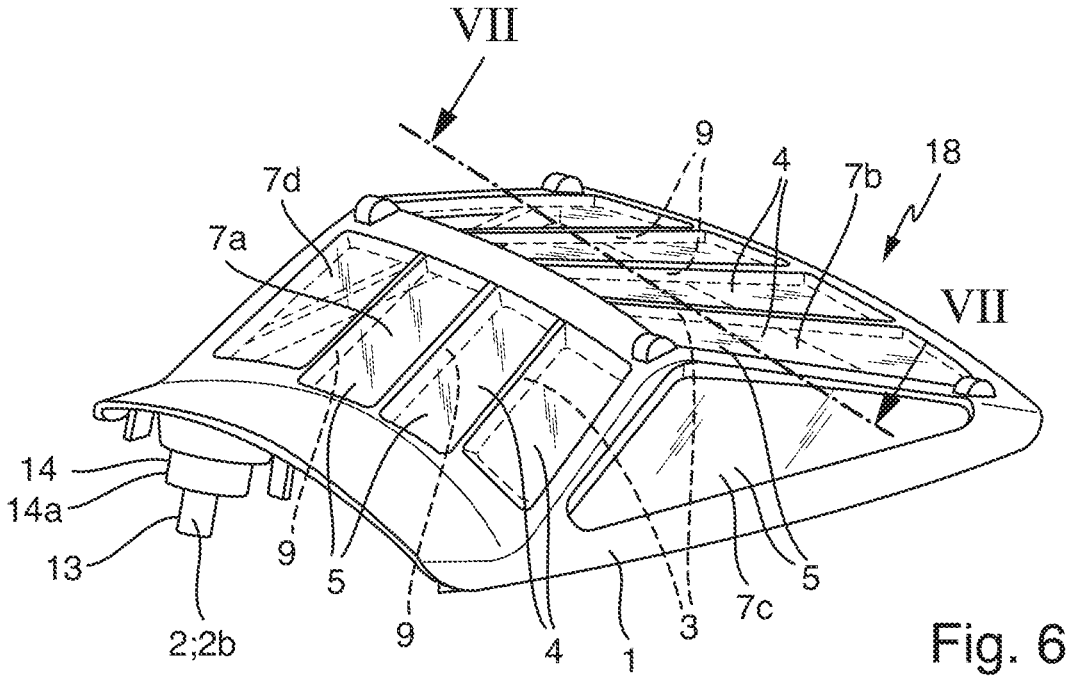
FIG. 6 a perspective view of an outside of the air filter from FIG. 5.
Figure 7:
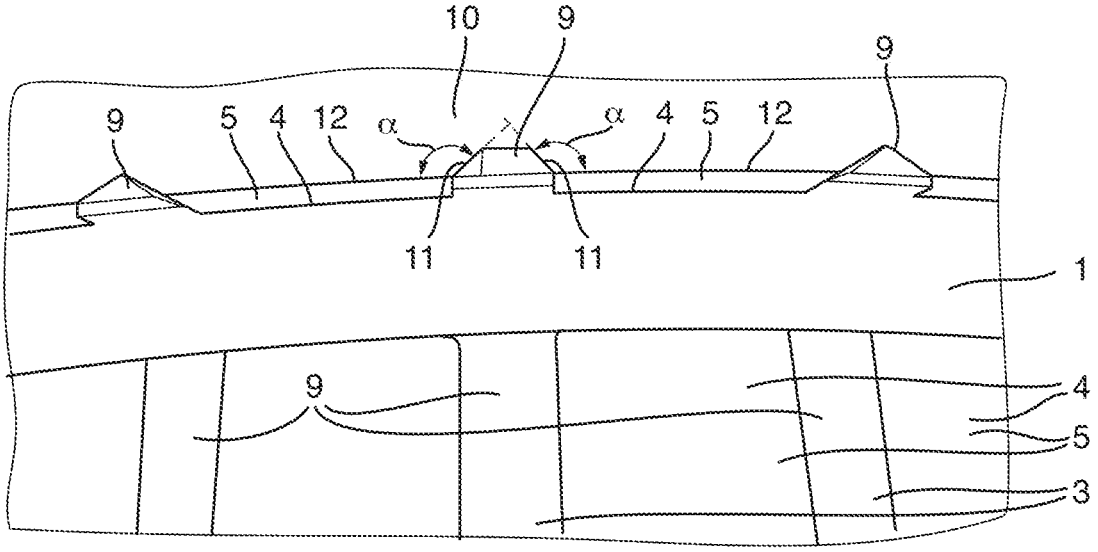
FIG. 7 a sectional view along line VII-VII in FIG. 6.

As becomes clearer in connection with FIGS. 5 to 7, the air filter 18 comprises a filter frame body 1 with a filter-fabric-free air outlet face 8 and a window frame structure 3 protruding above the air outlet face 8 and having at least one window region 4, and a filter fabric 5 occupying the at least one window region 4, and a fixation 2 for releasable fixing of the filter frame body 1. In the exemplary embodiment of FIGS. 5 to 7, the air outlet face 8 is formed by the quadrangular face lying at the top in the view in FIG. 5, with four associated corner regions 8*a*, 8*b*, 8*c*, 8*d*. When used for the working apparatus of FIGS. 1 to 4, the air outlet face 8 conforms to the air inlet 16 of the housing 15 and faces this, and the fixation 2 serves for releasable fixing of the filter frame body 1 to the housing 15. It is understood that the air filter 18 may also be used for any other purposes wherever suitable, where there is a need to cover an air inlet with a dirt-repelling filter fabric such as the filter fabric 5.

In corresponding embodiments of the air filter 18, as in the example shown in FIGS. 5 to 7, the window frame structure 3 has frame webs 9 which delimit the at least one window region 4, protrude relative to the filter fabric 5 towards an air supply side 10 in the at least one window region 4, and have web side edges 11 which run sloping at an obtuse angle α relative to adjacent window planes 12, as evident in particular from the sectional view of FIG. 7. The obtuse angle α lies in the range between 90° and 180°, in particular in the range between 100° and 160°, preferably between 120° and 150°. The window planes 12 are defined by a plane of the respective window region 4.

This design of frame webs 9, which protrude relative to the filter fabric 5 towards the air supply side 10 with sloping side edges 11, facilitates cleaning of the air filter 18 for removal of dirt deposited on its outside, and may also have a favorable effect on the flow behavior of the air which flows from the outside through the respective window region 4 or the filter fabric 5 positioned therein, and hence also passes along the frame webs 9.

In corresponding embodiments, as in the exemplary embodiment shown, the fixation 2 comprises a pre-fixing clamping holding arrangement 2*a* and a final fixing holding arrangement 2*b* which are independent of each other. The pre-fixing clamping holding arrangement 2*a* allows the air filter 18 with its filter frame body 1 to be pre-fixed at its proposed usage site, e.g. on an apparatus housing such as the housing 15 of the working apparatus of FIGS. 1 to 4, where it can then be definitively fixed in releasable fashion by the final fixing holding arrangement 2*b*, e.g. to the housing 15 of the working apparatus of FIGS. 1 to 4 or on another apparatus housing or at another fixing location.

In corresponding embodiments, as in the example shown, the final fixing holding arrangement 2*b* is a screw connection with a fixing screw 13 and a screw sleeve 14 formed on the filter frame body 1. In an advantageous implementation, as in the example shown, the pre-fixing clamping holding arrangement 2*a* is formed on the sleeve outer periphery 14*a* of the screw sleeve 14, e.g. in the form of a clamping edge flattening 32 of the otherwise cylindrical sleeve outer periphery 14*a*, wherein in this case the clamping edge flattening 32 may cooperate with a corresponding counter clamping element 34. When the air filter 18 is used on the working apparatus of FIGS. 1 to 4, the counter clamping element 34 may be formed e.g. by a facing wall portion in the region of the air inlet 16 of the housing 15, as shown in FIGS. 3 and 4. The air filter 18 may then be pre-fixed to the housing 15 by this clamping fixing, and the definitive fixing can then be made by connecting the fixing screw 13 to an associated counter connecting element on the housing 15. Because of the clamping pre-fixing, the air filter 18 need not be held in position by the user during final fixing.

In corresponding implementations, as in the example shown, the fixing screw 13 is received captively in the screw sleeve 14. The fixing screw 13 may thereby be pre-mounted on the air filter 18 before its final fixing, and is then already at the desired usage point for final fixing of the air filter 18.

In advantageous embodiments, as in the exemplary embodiment shown, the window frame structure 3 comprises a multisurface structure with at least four air inlet faces 7*a*, 7*b*, 7*c*, 7*d* adjoining each other at an angle along associated frames side edges 6. Advantageously, as in the example shown, the at least four air inlet faces 7*a*, 7*b*, 7*c*, 7*d* may comprise a quadrangular front inlet face 7*a* adjoining the air outlet face 8 at an acute angle, a quadrangular bottom inlet face 7*b* adjoining the front inlet face 7*a* and adjoining the air outlet face 8 at an acute angle, and two triangular transverse inlet faces 7*c*, 7*d* each adjoining the air outlet face 8, the front inlet face 7*a* and the bottom inlet face 7*b*. For corresponding applications, this constitutes a roof-shaped design, which is favorable with respect both to a large air inlet face or filter-fabric face and to an air inflow for the air filter 18, which curves hood-like in the direction of the air supply side 10. In the example shown, the front inlet face 7*a* and the bottom inlet face 7*b* each comprise four window regions 4, and the two triangular transverse inlet faces 7*c*, 7*d* each comprise one window region 4.

In corresponding embodiments, as in the example shown, the window frame structure 3 of the air filter 18 protrudes over the filter-fabric-free air outlet face 8 in the shape of a roof with a triangular cross-sectional form. For corresponding applications, this constitutes a favorable design of the air filter 18 with respect to both provision of a large air inlet face or filter-fabric face for a given extent of the air outlet face 8 or housing air inlet 16, and/or with respect to air inflow.

In advantageous embodiments, the filter frame body 1 is an injection moulding of a plastic material, and the filter fabric 5 is a metallic filter fabric which is over-moulded on the edges by the plastic material of the filter frame body 1. Thus the filter fabric 5 is connected in stable fashion to the window frame structure 3 with relatively little production complexity. The filter fabric 5 may for example consist of stainless steel and/or have a filter mesh width in the range from approximately 0.4 mm to 0.6 mm, and/or a mesh wire thickness of between approximately 0.30 mm and 0.33 mm.

As the exemplary embodiments shown and explained above make clear, the invention provides an advantageous motorized working apparatus with a specially designed and/or attached air filter, and an air filter which is suitable for such a working apparatus and other similar applications and has a design that is curved hood-like towards the air inlet side, in particular in a roof shape. Advantageously, the air filter is particularly suitable for manually guided, motorized gardening and forestry working apparatuses such as hedge cutters, hedge shears, strimmers, pruners and other similar above-mentioned apparatuses.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A motorized working apparatus, comprising:

a housing with an air inlet;

an air guide leading from the air inlet into the housing; and an air filter which is curved hood-shaped outwardly and covers the air inlet of the housing, and which comprises a filter frame body with a filter-fabric-free air outlet face facing the air inlet of the housing and with a window frame structure protruding over the filter-fabric-free air outlet face and having at least one window region, a filter fabric occupying the at least one window region, and a fixation for releasable fixing of the filter frame body to the housing, wherein the air filter further comprises at least one of the following features:

(i) the fixation comprises a pre-fixing clamping holding arrangement and a final fixing holding arrangement which are independent of each other, or (ii) the window frame structure of the air filter protrudes over the filter-fabric-free air outlet face in the shape of a roof with a triangular cross-sectional form.

2. The motorized working apparatus according to claim 1, further comprising:

a working tool outside the housing and a connecting shaft between the working tool and the housing, wherein the air inlet is situated on a half of the housing facing the working tool.

3. The motorized working apparatus according to claim 1, wherein the apparatus is configured for operation in at least one predefined usage position, and the air inlet covered by the air filter is situated in a region of the housing pointing downward in said predefined usage position.

4. The motorized working apparatus according to claim 1, further comprising:

an apparatus component to be cooled, situated in the housing; and a cooling air fan, wherein the air guide forms a cooling air guide which leads from the air inlet of the housing, via the apparatus component to be cooled and the cooling air fan, to an air outlet of the housing which is situated in a region of the housing between a housing front side and a housing rear side.

5. The motorized working apparatus according to claim 4, further comprising:

a housing seal which seals the housing at least on a suction side of the cooling air fan against at least one of supply air and dirt ingress except for the air inlet.

6. The motorized working apparatus according to claim 1, wherein the window frame structure forms a multisurface structure with at least four air inlet faces adjoining each other at an angle along associated frame side edges.

7. The motorized working apparatus according to claim 6, wherein the at least four air inlet faces comprise a quadrangular front inlet face adjoining the air outlet face at an acute angle, a quadrangular bottom inlet face adjoining the front inlet face and adjoining the air outlet face at an acute angle, and two triangular transverse inlet faces each adjoining the air outlet face, the front inlet face and the bottom inlet face.

8. The motorized working apparatus according to claim 1, wherein the filter frame body is an injection moulding of a plastic material, and the filter fabric is a metallic filter fabric which is overmoulded on the edges by the plastic material of the filter frame body.

9. The motorized working apparatus according to claim 1, wherein the final fixing holding arrangement is a screw connection with a fixing screw and a screw sleeve which is formed on the filter frame body, and the pre-fixing clamping holding arrangement is formed on a screw sleeve outer periphery, or the fixing screw is captively received in the screw sleeve.

10. An air filter, comprising:

a filter frame body having frame parts enclosing a filter-fabric-free air outlet face, the filter frame body further having a window frame structure protruding from the frame parts above the air outlet face and having at least one window region forming an air inlet face for entering air that is outlet through the air outlet face;

a filter fabric occupying the at least one window region; and a fixation for releasable fixing of the filter frame body, wherein the air filter further comprises at least one of the following features:

(i) the fixation comprises a pre-fixing clamping holding arrangement and a final fixing holding arrangement which are independent of each other, or (ii) the window frame structure of the air filter protrudes over the filter-fabric-free air outlet face in the shape of a roof with a triangular cross-sectional form.

11. The air filter according to claim 10, wherein the window frame structure forms a multi-surface structure with at least four air inlet faces adjoining each other at an angle along associated frame side edges.

12. The air filter according to claim 11, wherein the at least four air inlet faces comprise a quadrangular front inlet face adjoining the air outlet face at an acute angle, a quadrangular bottom inlet face adjoining the front inlet face and adjoining the air outlet face at an acute angle, and two triangular transverse inlet faces each adjoining the air outlet face, the front inlet face and the bottom inlet face.

13. The air filter according to claim 10, wherein the filter frame body is an injection moulding of a plastic material, and the filter fabric is a metallic filter fabric which is overmoulded on the edges by the plastic material of the filter frame body.

14. The air filter according to claim 10, wherein the final fixing holding arrangement is a screw connection with a fixing screw and a screw sleeve which is formed on the filter frame body, and the pre-fixing clamping holding arrangement is formed on a screw sleeve outer periphery, or the fixing screw is captively received in the screw sleeve.

15. The motorized working apparatus according to claim 1, wherein the apparatus is a manually guided motorized gardening or forestry working apparatus.

16. The air filter according to claim 10, wherein the air filter is configured for being mounted on a motorized working apparatus.

17. A motorized working apparatus, comprising:

a housing with an air inlet;

an air guide leading from the air inlet into the housing;

a working tool outside the housing;

a connecting shaft between the working tool and the housing, wherein the air inlet is situated on a half of the housing facing the working tool; and an air filter which is curved hood-shaped outwardly and covers the air inlet of the housing, and which comprises a filter frame body with a filter-fabric-free air outlet face facing the air inlet of the housing and with a window frame structure protruding over the filter-fabric-free air outlet face and having at least one window region, a filter fabric occupying the at least one window region, and a fixation for releasable fixing of the filter frame body to the housing, wherein the window frame structure has frame webs which delimit the at least one window region and which protrude relative to the filter fabric towards an air supply side in the at least one window region and comprise web side edges which run sloping at an obtuse angle relative to adjacent window planes, and wherein the window frame structure forms a multisurface structure with at least four air inlet faces adjoining each other at an angle along associated frame side edges, the at least four air inlet faces comprising a quadrangular front inlet face adjoining the air outlet face at an acute angle, a quadrangular bottom inlet face adjoining the front inlet face and adjoining the air outlet face at an acute angle, and two triangular transverse inlet faces each adjoining the air outlet face, the front inlet face and the bottom inlet face, or the fixation comprises a pre-fixing clamping holding arrangement and a final fixing holding arrangement which are independent of each other, or the window frame structure of the air filter protrudes over the filter-fabric-free air outlet face in the shape of a roof with a triangular cross-sectional form.

18. The motorized working apparatus according to claim 17, wherein the apparatus is configured for operation in at least one predefined usage position, and the air inlet covered by the air filter is situated in a region of the housing pointing downward in said predefined usage position.

19. The motorized working apparatus according to claim 17, further comprising:

an apparatus component to be cooled, situated in the housing; and a cooling air fan, wherein the air guide forms a cooling air guide which leads from the air inlet of the housing, via the apparatus component to be cooled and the cooling air fan, to an air outlet of the housing which is situated in a region of the housing between a housing front side and a housing rear side.

20. The motorized working apparatus according to claim 19, further comprising:

a housing seal which seals the housing at least on a suction side of the cooling air fan against at least one of supply air and dirt ingress except for the air inlet.

21. The motorized working apparatus according to claim 17, wherein the filter frame body is an injection moulding of a plastic material, and the filter fabric is a metallic filter fabric which is overmoulded on the edges by the plastic material of the filter frame body.

* * * * *